US007494103B1

(12) United States Patent
Huebner

(10) Patent No.: US 7,494,103 B1
(45) Date of Patent: Feb. 24, 2009

(54) PLATFORM FOR SECURING A MIXING CONTAINER

(76) Inventor: Allen L. Huebner, P.O. Box 322, Glenwood, IA (US) 51534

( * ) Notice: Subject to any disclaimer, the term of this patent is extended or adjusted under 35 U.S.C. 154(b) by 532 days.

(21) Appl. No.: 11/182,616

(22) Filed: Jul. 15, 2005

(51) Int. Cl.
*B65D 19/00* (2006.01)

(52) U.S. Cl. ..... 248/346.07; 248/310; 248/313; 248/346.06; 248/346.01

(58) Field of Classification Search ..... 248/154, 248/151, 146, 147, 346.06, 346.01, 346.07, 248/346.5, 310, 313, 316.2, 346.7, 176.1, 248/176.3, 222.13, 231.31, 298.1, 230.2; 403/348, 350; 366/349; 220/628, 629, 630, 220/737

See application file for complete search history.

(56) References Cited

U.S. PATENT DOCUMENTS

| | | | | |
|---|---|---|---|---|
| 2,576,832 A | | 11/1951 | Gibson | 248/149 |
| 3,904,158 A | * | 9/1975 | Michael | 248/668 |
| 4,877,208 A | * | 10/1989 | Kennard, Jr. | 248/146 |
| 5,110,147 A | * | 5/1992 | Gershman | 280/79.5 |
| 5,232,188 A | | 8/1993 | Troncone | 248/154 |
| 5,551,183 A | * | 9/1996 | Solem | 43/17 |
| 5,560,578 A | * | 10/1996 | Schenken et al. | 248/313 |
| 6,227,513 B1 | * | 5/2001 | Richard | 248/346.07 |
| 6,361,001 B1 | | 3/2002 | Durand | 248/146 |
| 6,375,134 B1 | * | 4/2002 | Goldschmidt et al. | 248/154 |
| 6,464,184 B1 | * | 10/2002 | Lytle | 248/126 |
| 6,779,915 B2 | | 8/2004 | Foster, Jr. | 366/129 |
| 6,829,800 B2 | | 12/2004 | Roebuck | 7/151 |
| 7,258,312 B2 | * | 8/2007 | Grosse | 248/154 |
| 7,261,262 B2 | * | 8/2007 | Dunson | 248/154 |

* cited by examiner

*Primary Examiner*—J. Allen Shriver
*Assistant Examiner*—Todd M. Epps
(74) *Attorney, Agent, or Firm*—Holland & Hart LLP

(57) ABSTRACT

A platform is provided for securing a container while contents within the container are being mixed. A plurality of engagement blocks and a wedge member extend upwardly from a platform and define a container engagement area into which the container is placed. The wedge member is moved into an engagement position that decreases the container engagement area and secures the container. An area on the platform is provided on which a user stands to provide additional stability to the platform. A support block may be provided behind the wedge member. Channels may be provided to divert debris from the surface of the platform. A handle support may be provided to support tools in an upright position when not in use.

20 Claims, 4 Drawing Sheets

PLATFORM FOR SECURING A MIXING CONTAINER

BACKGROUND OF THE INVENTION

1. Field of the Invention

The present invention relates to systems used to mix materials and more particularly to a platform that releasably receives mixing containers in a position that substantially prevents movement of the mixing containers while their contents are being mixed.

2. Description of the Prior Art

Several different materials are commonly used in the construction and repair of homes that require mixing. An example of some of these materials include joint compounds, paints, grout, adhesive, paints, and the like. Many of these materials are removed from their original packaging or containers and disposed within five gallon buckets or other mixing containers at the job site so that they may be properly prepared for use. While the materials could be manually mixed with a paddle or other such instrument, it is more common to see such materials mixed with a mixing paddle attached to a drill or other common rotary electric device. However, many of these materials are thick and require a significant amount of force to mix the material within the container. Accordingly, an unsupported container typically spins and wobbles as the material is being mixed. This not only increases the time required to properly mix the material but can also cause a mess as material is spilled from the container.

The typical prior art method of supporting a mixing container employs the use of the individual's feet or knees, tightly clamped against opposite sides of the mixing container. Unfortunately, this requires the individual to apply constant pressure against the container while mixing the material. This causes fatigue and may even cause the individual to lose his footing or fall.

U.S. Pat. No. 4,877,208 discloses a support for a mixing container that provides a platform having a circular recess at one end and an area for supporting the individual at the opposite end. The recess is sized and shaped to provide a snug fit around the bottom portion of the container. A non-skid material, similar to sand paper, lines the bottom and sides of the recess to engage the mixing container with a frictional force. While this is an improvement over gripping the opposite sides of the pale with the individual's knees, it too suffers from a number of shortcomings. First, the recess is not adjustable in size or shape to accommodate different containers. Some materials may be mixed in their original container, which come in a wide array of shapes and sizes. Secondly, reliance upon a friction fit within a non-adjustable recess is unsatisfactory in the construction arts. The typical construction area may have debris and fluids accidentally spilling onto various surfaces. Where such debris finds its way between the mixing container and the recess, the power of the frictional engagement will decrease rapidly. Moreover, the continued insertion of a single mixing container within the recess will, over time, deteriorate the frictional engagement between the container and the recess due to wear on both surfaces.

U.S. Pat. No. 5,232,188 discloses a mixing jug having a circular ring member that is supported above an operating surface by a U-shaped foot. A pair of struts extend downwardly from the ring and terminate in a pair of footpads that are positioned slightly above the operating surface. In use, the individual places the container within the ring and then stands on the footpads, which flexes the circular ring into an elliptical shape, grasping opposite side portions of the mixing container. Clearly, this device suffers from many of the prior art shortcomings encountered previously. First, it requires the individual to stand on the apparatus in order to provide the compression force on the container. Secondly, in its resting position, the device tends to wobble back and forth with the mixing container supported above the operating surface. Accordingly, due to an elevated center of gravity, it is easy to tip the apparatus with the mixing container disposed therein. Finally, the ring is provided in a non-adjustable manner, which prevents the use of mixing containers of various shapes and sizes.

U.S. Pat. No. 6,464,184 discloses a platform for securing a mixing container that has a pair of wing members, foldably disposed at opposite ends of the platform. The mixing container is positioned in the center of the platform and the wing members are folded back against the upper surface of the platform. A curved or angular shape is removed from the wing members and secured around the side portions of the mixing container. However, the device operates based upon the assumption that the shape and size of the container is slightly larger than the opening formed between the wing members, allowing at least one of the wing members to tightly engage the mixing container and stop at an angled position above the platform. Accordingly, only containers within a narrow range of shapes and sizes will be usable with this device. This design also requires the weight of the individual to engage the sides of the mixing container. Moreover, the individual must stand on an uneven and angled surface, which may promote accidents.

Accordingly, what is needed is a new device for securing a container while contents within the container are being mixed. Such a device should provide a safe and effective way of securing containers of various sizes and shapes, while remaining compact and light weight.

SUMMARY OF THE INVENTION

The present invention provides a platform for securing a mixing container while the contents within the mixing container are being mixed. The platform is comprised of a generally plainer base, having upper and lower surfaces and a peripheral edge. A plurality of engagement blocks extend upwardly from the upper surface of the base and are each provided with at least one engagement face. A wedge member is provided, having at least one engagement face along its forward surface. The engagement blocks and the wedge member are positioned in a spaced relationship with one another so that the engagement faces of the engagement blocks and the wedge member generally face one another to define the periphery of a container engagement area. The wedge member is slidably movable along a predetermined, linear path that extends across the upper surface of the base. The engagement face of the wedge member is positioned at an angle with respect to the linear path so that the engagement face gradually decreases the size of the container engagement area when the wedge member is moved into an engagement position along the linear path. Likewise, the engagement face gradually increases the diameter of the container engagement area when the wedge member is moved in an opposite direction, out of the engagement position.

In one embodiment, the wedge member is slidably coupled with the base. In other embodiments, the wedge member may be separate from the base. Still another embodiment provides two generally opposing engagement faces on the wedge member. In this embodiment, the wedge member may be moved into a first engagement position in order to prevent clockwise rotation of the mixing container or the wedge member may be moved into a second engagement position to inhibit counter clockwise rotation of the mixing container.

The container engagement area is positioned along the base in a manner that permits the individual to stand on top of the base, adjacent the container engagement area. In one embodiment, channels are formed within the base in order to divert debris or fluids from the upper surface. In one embodiment, a generally elongated handle support is provided to extend upwardly from the base and is sized and shaped to receive the handle of a tool and support the tool in a generally upright position. The base may also be provided with a handle in order to provide easy relocation of the platform. A support block may be provided to extend upwardly from the base behind the wedge member in order to permit a great compression force to be enacted upon the container by the wedge member. While the shape of the wedge member permits the use of containers having various sizes and shapes, the engagement blocks may be provided with shims or may also be adjustable in their positions with respect to the container engagement area to increase or decrease the same.

It is therefore a principle object of the present invention to provide a device for securing a mixing container while the contents within the mixing container are being mixed.

A further object of the present invention is to provide a device for securing a mixing container that is easily adapted to secure mixing containers of various sizes and shapes.

Still another object of the present invention is to provide a device for securing a mixing container that does not require the user to apply constant force or weight to the device in order to engage the mixing container.

A further object of the present invention is to provide a device for securing mixing containers that is lightweight and portable.

Still another object of the present invention is to provide a device for securing mixing containers that may also support tools in a generally upright position when they are not in use.

Yet another object of the present invention is to provide a device for securing a mixing container that is provided with a plurality of channels that permit debris or fluids to flow from the upper surface of the device and provide stable footing for a user.

A further object of the present invention is to provide a device for securing mixing containers that is relatively simple and inexpensive to manufacture.

These and other objects of the present invention will be apparent to those having skill in the art.

DESCRIPTION OF THE PREFERRED EMBODIMENT

Figure 1:
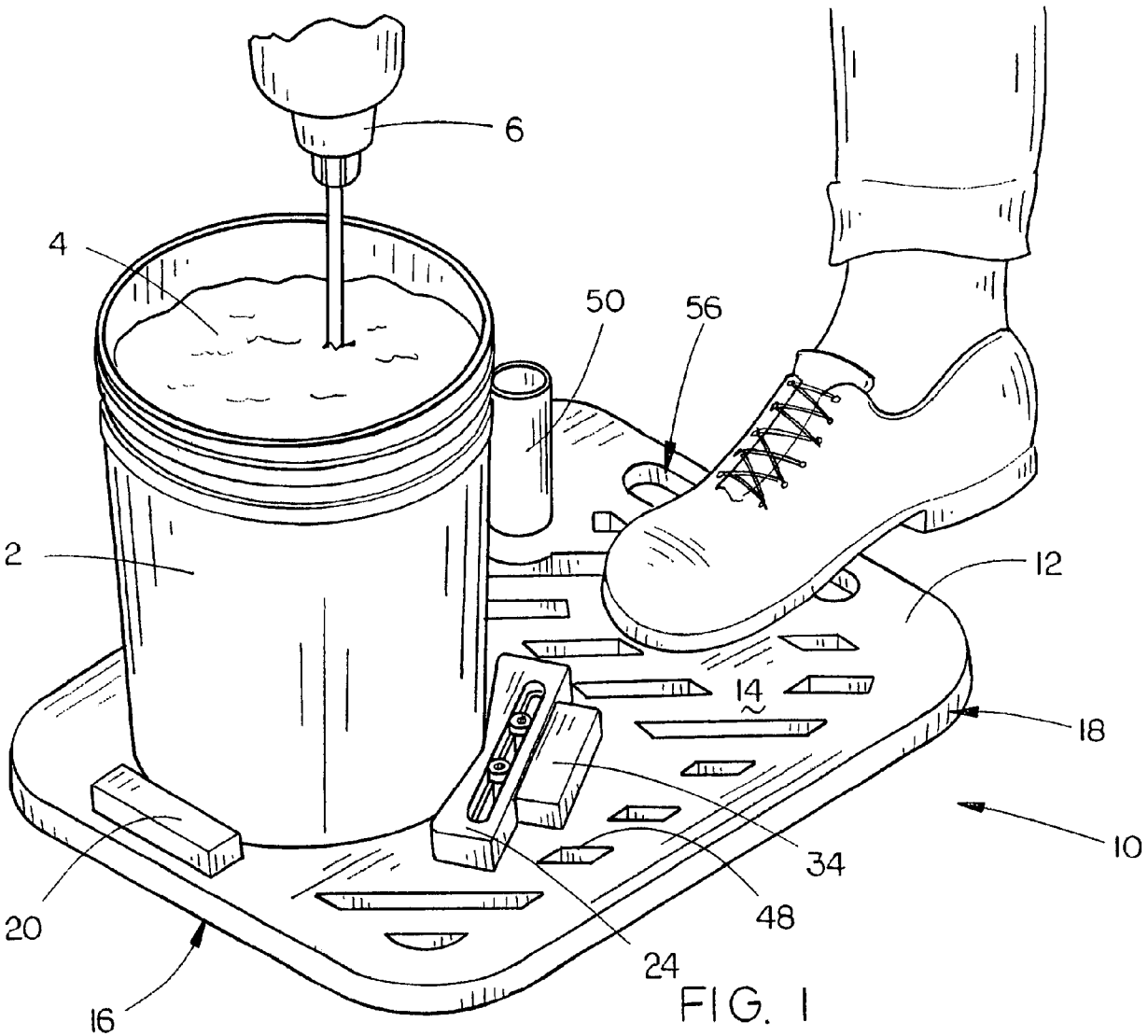
FIG. 1 is an isometric view of one embodiment of the mixing platform of the present invention as the same could be used with a mixing container and mixing apparatus.
Figure 2:
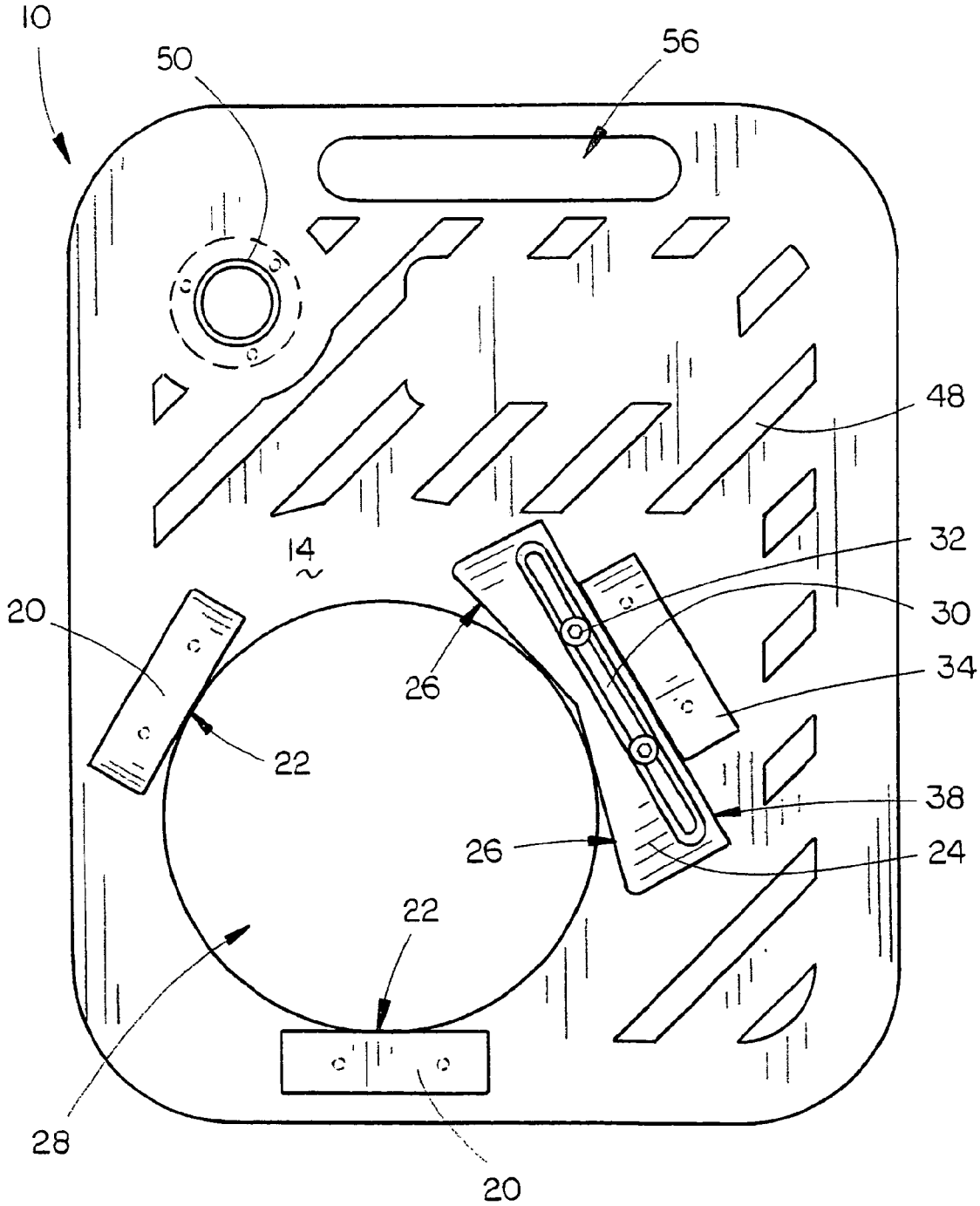
FIG. 2 is a top plan view of the mixing platform depicted in FIG. 1.

In the following detailed description of exemplary embodiments, reference is made to accompanying FIGS. 1-4, which form a part hereof and show, by way of illustration, exemplary embodiments of the present invention. These embodiments are disclosed in sufficient detail to enable those skilled in the art to practice the invention. It is to be understood that other embodiments may be utilized, however, and other changes may be made without departing from the spirit or scope of the present invention. The following detailed description is, therefore, not to be taken in a limiting sense in that the scope of the present invention is defined only by the appended claims.

The platform 10 for securing a mixing container 2, while contents 4 within the mixing container 2 are being mixed, is provided with a base 12, having an upper surface 14, a lower surface 16, and a peripheral edge portion 18. A plurality of engagement blocks 20 should extend upwardly from the upper surface 14 of the base 12 and are provided with engagement faces 22. A wedge member 24, having at least one engagement face 26, positioned along a forward surface of the wedge member 24, is positioned closely adjacent the upper surface 14 of the base 12. As depicted in the accompanying figures, the engagement blocks 20 and the wedge member 24 are positioned in a relationship with one another such that the engagement faces 22 of the engagement blocks 20 and the engagement face 26 of the wedge member 24 generally face one another and define the periphery of a container engagement area 28. The container engagement area 28 should be shaped and sized to receive at least a lower end portion of the mixing container 2.

The wedge member 24 is preferably positioned so that it may be selectively moved along a pre-determined, linear path that extends across the upper surface 14 of the base 12. As depicted in the Figures, the engagement face 26 of the wedge member 24 is positioned at an angle with respect to the linear path on which the wedge member 24 moves. Accordingly, moving the wedge member 24 in one direction along the linear path into an engagement position will move at least a portion of the engagement face 26 in a manner that gradually decreases the size of the container engagement area 28. Likewise, moving the wedge member 24 in an opposite direction along the linear path, out of the engagement position, will gradually increase the diameter of the container engagement area 28.

The wedge member 24 may be slidably coupled with the upper surface 14 of the base 12. In one preferred embodiment, this is attained by forming an elongated slot 30 along a length of the wedge member 24. A plurality of pins 32 are disposed through the elongated slot 30 and are secured to the base 12. The elongated slot 30 and pins 32 act in concert with one another to define the linear path upon which the wedge member 24 may be moved. Other structural embodiments are contemplated, however, to attain a slidable engagement between the wedge member 24 and the base 12. For example, a shaped channel may be formed directly within the base 12 that receives one or more shaped projections that extend outwardly from a lower surface of the wedge member 24. Likewise, the wedge member 24 could simply be disposed within an elongated channel formed within the upper surface 14 of the base 12, permitting the wedge member to slide freely along the linear path.

In another preferred embodiment, a support block 34 may be provided to extend upwardly from the upper surface 14 of the base 12. The support block 34 should be provided with at least one engagement face 36 that is positioned closely adjacent a rearward face 38 of the wedge member 24. This structural arrangement will provide a positive stop for the wedge member 24 when the wedge member 24 is moved into its engagement position. The use of a support block 34 may provide structural support in addition to the pins 32 or other such structural fastener, in order to prevent the unintentional release of the wedge member 24. However, use of a support block 34 further enables the use of a wedge member 24 that is releasably positioned adjacent the upper surface 14 of the base 12 without the use of mechanical fasteners.

In one preferred embodiment, the wedge member 34 is provided with a pair of engagement faces 26 that are both positioned at angles with respect to the linear path traveled by the wedge member 24 but face in different directions. This is most clearly depicted in FIG. 2. From the figure, it will be clear that the wedge member 34 provides two engagement positions, one for each of the engagement faces 26.

In use, the platform 10 is preferably placed with its lower surface 16 closely adjacent a stable operating surface. A mixing container 2 is positioned within the container engagement area 28 so that at least a lower end portion of the mixing container 2 is positioned closely adjacent the engagement faces 22 of the engagement blocks 20. Once the contents 4 are disposed within the mixing container 2, the individual may set the wedge member 24 by moving it along its linear path until it reaches its engagement position with the lower end portion of the mixing container 2. In this manner, the wedge member 24 applies a force against the mixing container 2, sandwiching it against the engagement faces 22 of the engagement blocks 20. The use of a pair of engagement faces 26 on the wedge member 24 will be useful for those operations when the contents 4 must be mixed in different directions. This will more frequently be encountered when different mixing devices 6 are implemented or the specific contents for being mixed become more evenly mixed when alternating mixing directions are used. The individual easily changes between the alternate engagement positions by moving the wedge member 24 in a reciprocal fashion along its predetermined linear path.

Figure 4:
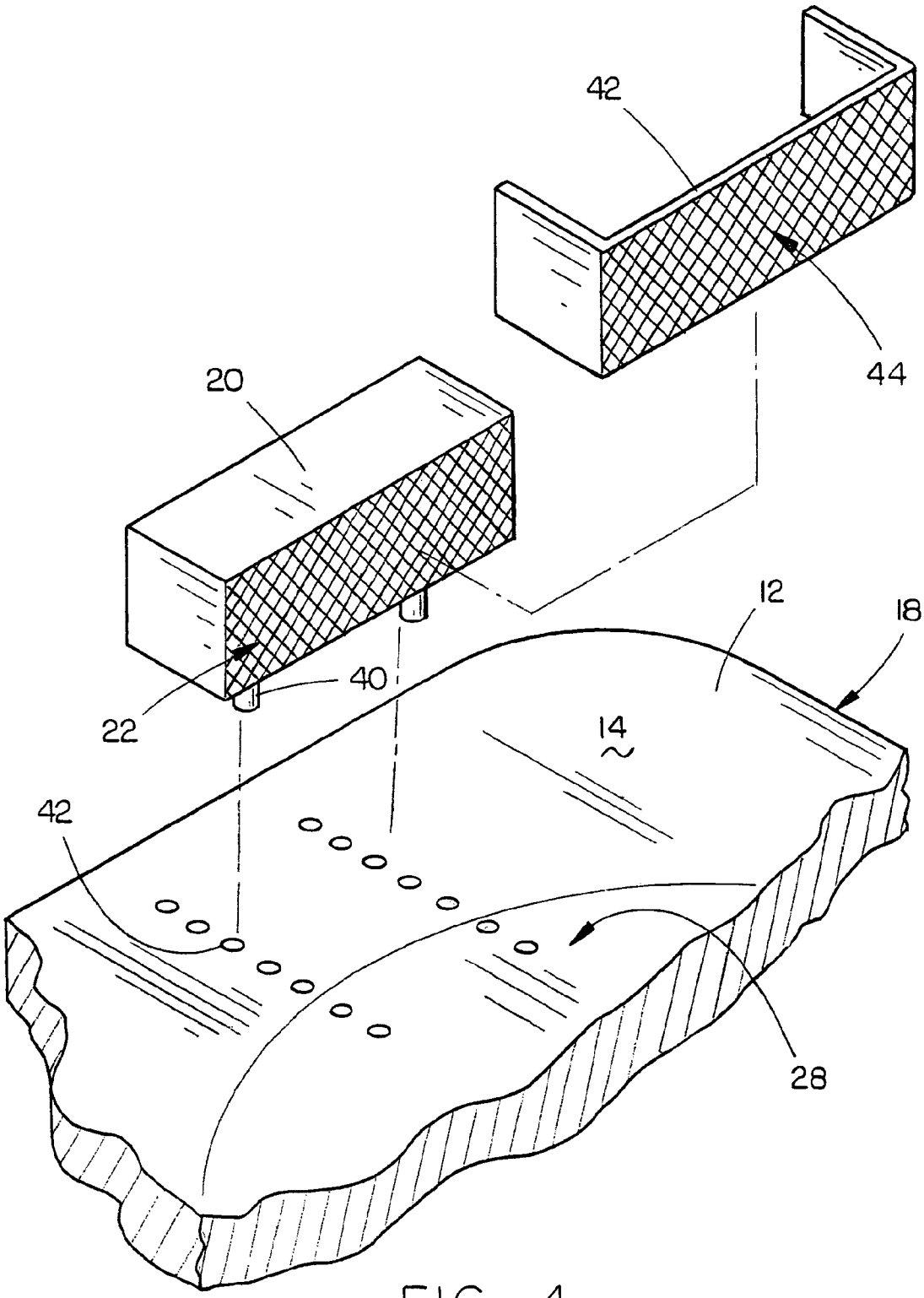
FIG. 4 is a partial exploded view of an engagement block and shim that may be used with one embodiment of the mixing platform of the present invention.

The size and angular configuration of the wedge member 24 will also define the extent to which the platform 12 may be used with mixing containers 2 having different diameters and shapes. It is also contemplated that mixing containers 2 of various sizes and shapes may be accommodated using other alternate embodiments of the platform 10. For example, FIG. 4 depicts one embodiment wherein at least one of the engagement blocks 20 is removably engagable with the base 12. The engagement block 20 is selectively movable along a predetermined linear path that extends across the upper surface 14 of the base 12, radially to the container engagement area 28. While the embodiment is depicted as utilizing a plurality of pins 40 and apparatures 42, other structures are contemplated. For example, shaped projections may be provided to extend from the engagement block 20 that would be received within shaped channels formed within the base 12.

In still another embodiment, at least one shim 42 may be used that is selectively engagable with the engagement face 22 of one or more of the engagement blocks 20. The shim 42 may be provided with an engagement face 44 and a predetermined thickness to provide an incremental adjustment for the resulting container engagement area 28. In one contemplated embodiment, the shim 42 is shaped to releasably engage the engagement face 22 of the engagement block 20. A pair of arm members 46 releasably engage generally opposing side surfaces of the engagement block 20. It is also contemplated however that the shim 42 may simply be coupled with the engagement block 20 using mechanical fasteners of various types.

Figure 3:
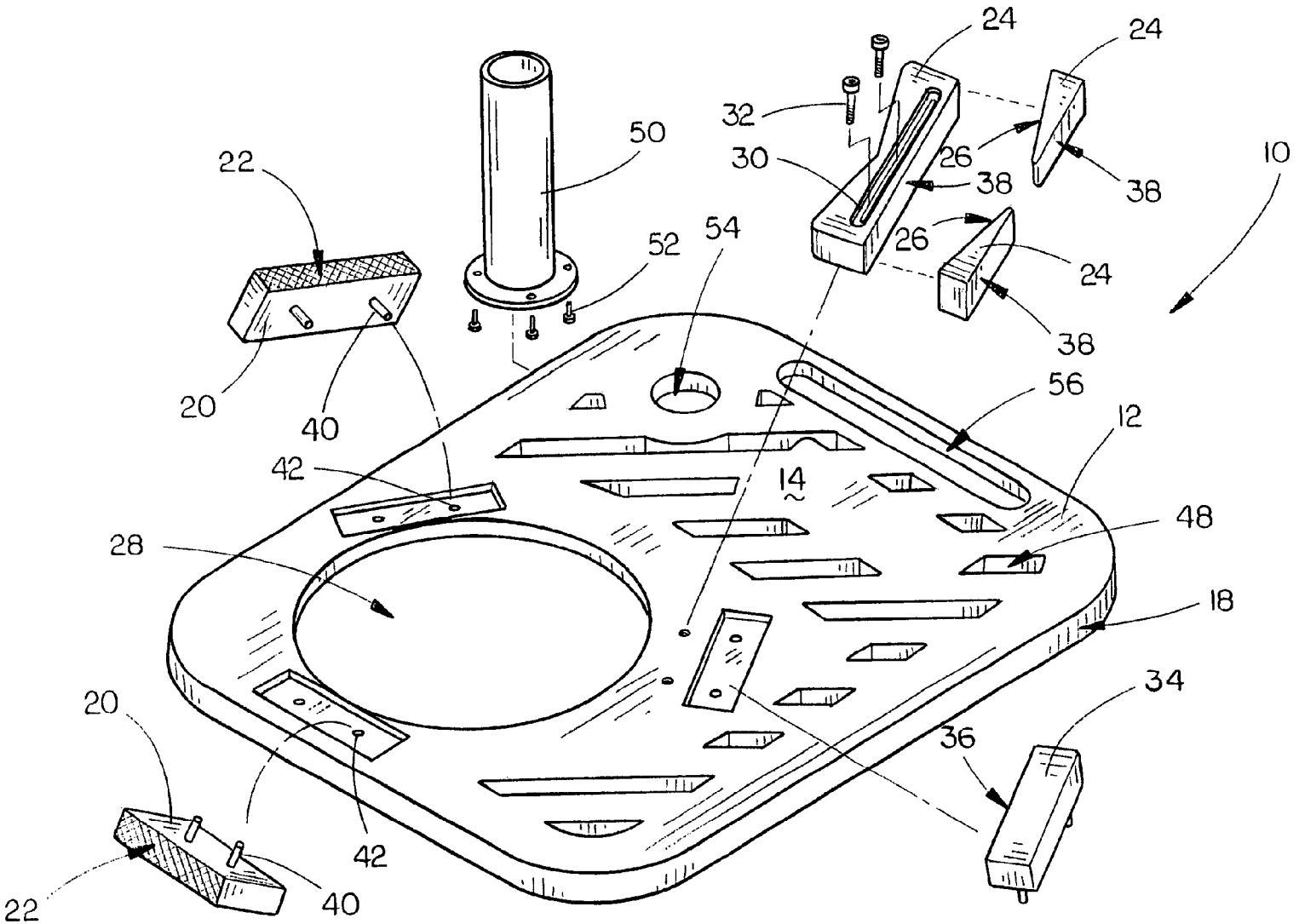
FIG. 3 is a partially exploded view of another embodiment of the mixing platform of the present invention.

In one embodiment, depicted in FIG. 3, the container engagement area 28 may be slightly recessed within the base 12. This will permit the engagement blocks 20 and the wedge member 24 to engage the mixing container 2 at a higher location. This may become beneficial when setting the wedge member 24 into its engagement position, due to the fact that most plastic and metal mixing containers have sidewalls that are somewhat resiliently deformable above the location where the sidewall engages the bottom of the mixing container. This allows the mixing container 2 to conform slightly within the container engagement area 28 defined by the engagement blocks and the wedge member 24.

In order to provide greater stability to the platform 10 when it is in use, the container engagement area 28 should be located in a position along the upper surface 14 of the base 12 that permits an individual to stand on the upper surface 14 of the base 12. In this manner, the weight of the individual will help the platform 10 to resist movement caused by mixing the contents 4 within the mixing container 2. However, the individual will be provided with a substantially level and stable surface on which to stand. In order to enhance the individual's safety, elongated channels 48 may be formed along the upper surface 14 of the base 12. The elongated channels 48 should be shaped and sized to receive debris and/or fluids from the upper surface 14 in order to reduce the likelihood that the individual will slip while standing on the platform 10. To that end, it is also contemplated that the elongated channels 48 may be formed completely through the base 12 and allow the passage of the debris and/or fluid away from the platform 12. It is further contemplated that forming the elongated channels 48 will further reduce the weight of the platform 10 and reduce the amount of material required to form the same. To that end, it is also contemplated that similarly elongated channels may be formed along the lower surface 16 of the base 12, forming structural ribs that retain the structural integrity of the platform 10.

Another embodiment of the platform 10 provides a generally elongated handle support 50 that extends upwardly from the base 12 and is sized and shaped to receive the handle of a tool and support the tool in a generally upright position. This will be particularly helpful for tools that are typically loaded with the materials being mixed within the mixing container 2. One example of such a tool is a texturing gun that has a hopper that must be loaded while the tool is in an upright position. Providing the handle support 50 will properly position the tool closely adjacent the source of the material that it will receive.

It may be preferable to provide the platform 10 in a modular construction that creates an interchangeability of parts. Accordingly, the platform 10 may be fully disassembled as depicted in FIG. 3. The engagement blocks 20 may be secured with the base 12 using pins 40 that are shaped to be received by apparatures 42. However, mechanical fasteners such as screws 52 may also be used. Similarly, the elongated handle support 50 may be passed through an opening 54 and secured to the lower surface 16 of the base 12 using mechanical fasteners, such as the screws 52, or a plurality of pins and apparatures. The resulting modular construction will create a platform 10 that will be easier to transport and store. To enable a user to more easily carry the platform 10 from one location to another, a handle 56 may be provided to the base 12. In one embodiment, shown in FIG. 3, the handle 56 may be formed by simply providing a recess or hole adjacent the peripheral edge portion 18 of the base 12.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A device for securing a mixing container while contents within the mixing container are being mixed, the device comprising:

a base having an upper surface, a lower surface and a peripheral edge portion;

a plurality of engagement blocks extending upwardly from the upper surface of said base; said engagement blocks each having at least one engagement face; and a wedge member having at least one engagement face along a forward surface of said wedge member;

said engagement blocks and said wedge member being positioned in a spaced relationship with one another such that the engagement faces of said engagement blocks and said wedge member generally face one another and define a periphery of a container engagement area that is shaped and sized to receive at least a portion of the container;

said wedge member being selectively movable along a predetermined, linear path that extends across the upper surface of said base in a manner that is spaced apart from and does not extend directly toward or away from said container engagement area; the engagement face of said wedge member being positioned at an angle with respect to said linear path so that the engagement face of said wedge member gradually decreases the size of said container engagement area when said wedge member is moved into an engagement position along said linear path and gradually increases the diameter of said container engagement area when said wedge member is moved in an opposite direction along said linear path, out of said engagement position.

2. The device of claim 1 wherein said wedge member is slidably coupled with the upper surface of said base.

3. The device of claim 1 further comprising a support block extending upwardly from the upper surface of said base; said support block having at least one engagement face that is positioned closely adjacent a rearward face on said wedge member, facing said container engagement area, and provides a positive stop for said wedge member when said wedge member is moved into said engagement position.

4. The device of claim 3 wherein said container engagement area is positioned along the upper surface of said base in a manner that provides a user support area that is sized and shaped to permit a user to stand on said base, adjacent said container engagement area.

5. The device of claim 4 further comprising a handle that is operatively coupled with said base.

6. The device of claim 4 further comprising a generally elongated handle support that extends upwardly from said base and is sized and shaped to receive the handle of a tool and support the same in a generally upright position.

7. The device of claim 4 further comprising a plurality of channels formed within the upper surface of said base that are shaped and sized to receive fluids and debris from the upper surface of said base.

8. The device of claim 7 wherein said channels are formed to pass through said base and permit the fluids and debris to pass to an operating surface below said base.

9. The device of claim 1 wherein at least one of said plurality of engagement blocks is selectively movable along a predetermined, linear path that extends across the upper surface of said base, radially to said container engagement area.

10. The device of claim 1 further comprising at least one shim that is selectively engagable with the engagement face of at least one of said plurality of engagement blocks to decrease the size of said container engagement area.

11. The device of claim 10 wherein said shim is shaped to releasably engage the engagement face and at least a portion of a pair of generally opposing side surfaces of said at least one of said plurality of engagement blocks.

12. A device for securing a mixing container while contents within the mixing container are being mixed, the device comprising:

a base having an upper surface, a lower surface and a peripheral edge portion;

a plurality of engagement blocks extending upwardly from the upper surface of said base; said engagement blocks each having at least one engagement face; and a wedge member having at least one engagement face along a forward surface of said wedge member, an elongated slot formed through top and bottom portions of said wedge member, and a plurality of pins that are disposed through said elongated slot and are selectively securable with said base;

said engagement blocks and said wedge member being positioned in a spaced relationship with one another such that the engagement faces of said engagement blocks and said wedge member generally face one another and define a periphery of a container engagement area that is shaped and sized to receive at least a portion of the container;

said wedge member being selectively movable along a predetermined, linear path that extends across the upper surface of said base in a manner that is spaced apart from and does not extend directly toward or away from said container engagement area; said linear path being at least partially defined by a configuration of the elongated slot in said wedge member; the engagement fate of said wedge member being positioned at an angle with respect to said linear path so that the engagement face of said wedge member gradually decreases the size of said container engagement area when said wedge member is moved into an engagement position along said linear path and gradually increases the diameter of said container engagement area when said wedge member is moved in an opposite direction along said linear path, out of said engagement position.

13. A device for securing a mixing container while contents within the mixing container are being mixed, the device comprising:

a base having an upper surface, a lower surface and a peripheral edge portion;

a plurality of engagement blocks extending upwardly from the upper surface of said base; said engagement blocks each having at least one engagement face; and a wedge member having first and second engagement faces along a forward surface of said wedge member;

said engagement blocks and said wedge member being positioned in a spaced relationship with one another such that the engagement faces of said engagement blocks and said wedge member generally face one another and define a periphery of a container engagement area that is shaped and sized to receive at least a portion of the container;

said wedge member being selectively movable along a predetermined, linear path that extends across the upper surface of said base in a manner that is spaced apart from and does not extend directly toward or away from said container engagement area; said first and second engagement faces being positioned at angles with respect to said linear path but face in different directions so that at least one of said first and second engagement faces of said wedge member gradually decreases the size of said container engagement area when said wedge member is moved into an engagement position along said linear path and gradually increases the diameter of said container engagement area when said wedge member is moved in an opposite direction along said linear path, out of said engagement position; said first and second engagement faces being positioned to separately and independently decrease the size of said container engagement area as said wedge member is moved in opposite directions along said linear path.

14. The device of claim 13 wherein said first engagement face is positioned to decrease the size of said container engagement area when said wedge member is moved into a first engagement position along said linear path and substantially prevent clockwise rotation of the container; said second engagement face being positioned to decrease the size of said container engagement area when said wedge member is moved into a second engagement position along said linear path and substantially prevent counterclockwise rotation of the container.

15. The device of claim 14 wherein an elongated slot is formed in said wedge member and a plurality of pins are disposed through said elongated slot and are secured to said base in a manner that slidably secures said wedge member with said base.

16. The device of claim 14 further comprising a support block extending upwardly from the upper surface of said base; said support block having at least one engagement face that is positioned closely adjacent a rearward face on said wedge member and provides a positive stop for said wedge member when said wedge member is moved into said engagement position.

17. The device of claim 16 wherein said container engagement area is positioned along the upper surface of said base in a manner that provides a user support area that is sized and shaped to permit a user to stand on said base, adjacent said container engagement area.

18. The device of claim 17 further comprising a handle that is operatively coupled with said base.

19. The device of claim 17 further comprising a plurality of channels formed within the upper surface of said base that are shaped and sized to receive fluids and debris from the upper surface of said base.

20. The device of claim 17 further comprising a generally elongated handle support that extends upwardly from said base and is sized and shaped to receive the handle of a tool and support the same in a generally upright position.

* * * * *